US010874593B2

(12) United States Patent
Bergersen

(10) Patent No.: US 10,874,593 B2
(45) Date of Patent: Dec. 29, 2020

(54) PACIFIER TO TRAIN PROPER TONGUE POSITION

(71) Applicant: Earl O. Bergersen, Glenview, IL (US)

(72) Inventor: Earl O. Bergersen, Glenview, IL (US)

(73) Assignee: ORTHO-TAIN, INC., Winnetka, IL (US)

( * ) Notice: Subject to any disclaimer, the term of this patent is extended or adjusted under 35 U.S.C. 154(b) by 0 days.

(21) Appl. No.: 16/515,420

(22) Filed: Jul. 18, 2019

(65) Prior Publication Data

US 2020/0179235 A1 Jun. 11, 2020

Related U.S. Application Data

(60) Provisional application No. 62/776,191, filed on Dec. 6, 2018.

(51) Int. Cl.
*A61J 17/00* (2006.01)

(52) U.S. Cl.
CPC ..... *A61J 17/113* (2020.05)

(58) Field of Classification Search
CPC ..... A61J 11/0005–045; A61J 17/001–02
See application file for complete search history.

(56) References Cited

U.S. PATENT DOCUMENTS 5,004,473 A * 4/1991 Kalantar ..... A61J 11/0035 215/11.1
6,080,186 A * 6/2000 Pedersen ..... A61J 17/001 606/234
8,603,140 B2 * 12/2013 Nipp ..... A61J 17/00 606/234
2003/0236556 A1 * 12/2003 Dickerson ..... A61J 17/02 606/235
2011/0184460 A1 * 7/2011 Hakim ..... A61J 17/02 606/234
2013/0304122 A1 * 11/2013 Bateman ..... A61J 17/001 606/236
2015/0272447 A1 * 10/2015 Ford ..... A61B 5/01 600/549

* cited by examiner

*Primary Examiner* — Thomas McEvoy
(74) *Attorney, Agent, or Firm* — Taft Stettinius & Hollister LLP

(57) ABSTRACT

A pacifier including a shield having a first side, a second side, a top portion, and a bottom portion, and a handle. The handle extends from the first side of the shield and defines a longitudinal axis. A nipple extends from the second side of the shield, wherein the nipple is inclined with respect to the longitudinal axis and extends downwardly from the longitudinal axis.

17 Claims, 4 Drawing Sheets

PACIFIER TO TRAIN PROPER TONGUE POSITION

CROSS-REFERENCE TO RELATED APPLICATION

This application claims priority to Provisional Patent Application Ser. No. 62/776,191 having the title "A Pacifier to Train Proper Tongue Position" filed Dec. 6, 2018, the disclosure of which is incorporated herein by reference in its entirety.

TECHNICAL FIELD

The present invention relates to an oral appliance and a method for maintaining proper dentitions in a child. More specifically, the present invention relates to one or more oral appliances which may be used in place of a traditional pacifier to thereby prevent improper guidance of a developing dentition of a child.

BACKGROUND OF THE DISCLOSURE

The statements in this section merely provide background information related to the present disclosure and should not be construed as constituting prior art.

It is generally known to provide a pacifier to an infant as a substitute for sucking instincts the child may develop, as well as to provide temporary comfort or to lull the infant to sleep by simulating a natural nipple. However, use of a pacifier often becomes habit-forming for an infant, and when it is used beyond the age of six months, the infant can experience sleep problems and orthodontic complications, including formational defects in a developing dentition. For example, a child sucking on a pacifier may cause constriction or narrowing of an upper jaw, which often results in a cross-bite of the dentition. Still other negative effects of pacifier usage include protrusion of the upper front teeth, jaw discrepancies, as well as problems with open bite, speech and swallowing.

Passive use of a pacifier during the period when the deciduous incisors are erupting may also cause problems, such as, for example, the development of an anterior open bite. If the deciduous anterior open bite is not prevented or treated, a child may also develop a permanent incisal open bite at six to eight years of age and may develop, for example, abnormal permanent swallowing, breathing and/or speech problems. In particular, prolonged usage of a pacifier retards the eruption of the incoming deciduous incisors since the nipple of the pacifier passes through the front of the mouth with a thickness that prevents the full normal eruption of the front teeth. Normally, the lower deciduous central teeth erupt through the gum tissue somewhere between 6 to 10 months (7.8 months on average), while the upper deciduous central teeth typically erupt between 8 to 12 months (9.6 months on average). Similarly, the lower deciduous lateral teeth generally erupt through the gums around 10 to 16 months (11.5 months on average), while the upper deciduous lateral teeth erupt somewhere between 9 to 13 months (12.4 months on average).

Between 14 and 18 months, the first lower deciduous molar typically erupts through the gum (15.1 months on average), while the first upper deciduous molar erupts between 16 to 22 months (18.3 months on average). The second lower deciduous molar typically erupts through the gum tissue between 23 and 31 months (26.0 months on average), while the second upper deciduous molar erupts somewhere between 25 and 33 months (26.2 months on average).

For a child, the period between the age of eighteen months and six years of age is critical to developing dentitions. Often, a poor pattern of development established during this childhood period causes the child to have a defective adult dentition that is nearly impossible to correct at older ages. Moreover, prolonged use of a pacifier can result in an infant developing a narrow palate and the reduced ability to breathe nasally, particularly considering that the pacifier can encourage the tongue to be positioned in the lower arch of the mouth instead of within the palate. By reducing the infant's nasal breathing ability, the pacifier can also encourage the infant to develop an open mouth breathing habit, which can lead to other health concerns, including an increased risk of sleep apnea and snoring. Moreover, the reduced air flow through the oropharynx as a result of mouth breathing allows the tongue to retract posteriorly (rearward), which can thereby cause the infant's airway to close down and/or to receive a reduced intake of oxygen, as well as to develop tonsil and adenoid swelling, which further limits the infant's ability to receive an adequate oxygen flow. When an infant experiences a reduced intake of oxygen while sleeping, the infant's ability to achieve REM sleep, which is crucial for keeping the infant's brain, immune and endocrine systems healthy, is negatively impacted. Instead, the infant experiences Delta sleep, which can result in the development of serious social and behavior problems, as well as bedwetting, infections and allergies.

A need, therefore, exists for an oral appliance that encourages an infant to maintain proper deciduous dentitions, while avoiding orthodontic complications and sleep concerns that may negatively impact the infant's current health and future well-being.

The present invention is intended to improve upon and resolve some of these known deficiencies of the art.

SUMMARY OF THE DISCLOSURE

The appliance or pacifier has a nipple angulated downward to encourage elevation of the tongue into the palate. It also has a shelf to receive the incisal deciduous teeth.

The same downward nipple includes inserted plastic (of stiffer material—higher hardness durometer) that inserts partly into the interior nipple to prevent it from being displaced upward and also being displaced within the shelf for teeth.

A narrowed space between the downward nipple and labial shield encourages lower jaw to grow forward during the earlier age up to about 20-24 months of age.

A labial shield surrounds the lips, located in front of the lips and the teeth, includes a shield shaped and designed like animals, and various other figures to encourage the child to use and to like the pacifier.

A downward nipple and shelf, made out of softer plastic, are included in one or more embodiments and can be made in different colors and/or glow in dark plastic.

A handle located in front of the shield includes a hole to attach the pacifier to pajamas and to prevent from going down throat of child.

A downward nipple having different sizes for different configurations of the pacifier weens the child away from using a pacifier, by varying sizes of pacifiers for different ages.

A pacifier includes features to train the tongue to position itself correctly within the palate.

In one embodiment, there is provided a pacifier including a shield having a first side, a second side, a top portion, and a bottom portion. A handle extends from the first side and defines a longitudinal axis. A nipple extends from the second side, wherein the nipple is inclined with respect to the longitudinal axis and extends downwardly from the longitudinal axis.

In another embodiment, there is provided a pacifier configured to encourage elevation of an individual's tongue into the individual's palate. The pacifier includes a nipple angulated downward from a longitudinal axis extending from a front of the pacifier to the back of a pacifier. A shelf is configured to receive incisal deciduous teeth of the individual.

BRIEF DESCRIPTION OF THE DRAWINGS

The above-mentioned aspects of the present application and the manner of obtaining them will become more apparent and the teachings of the present application itself will be better understood by reference to the following description of the embodiments of the present application taken in conjunction with the accompanying drawings, wherein.

Figure 1:
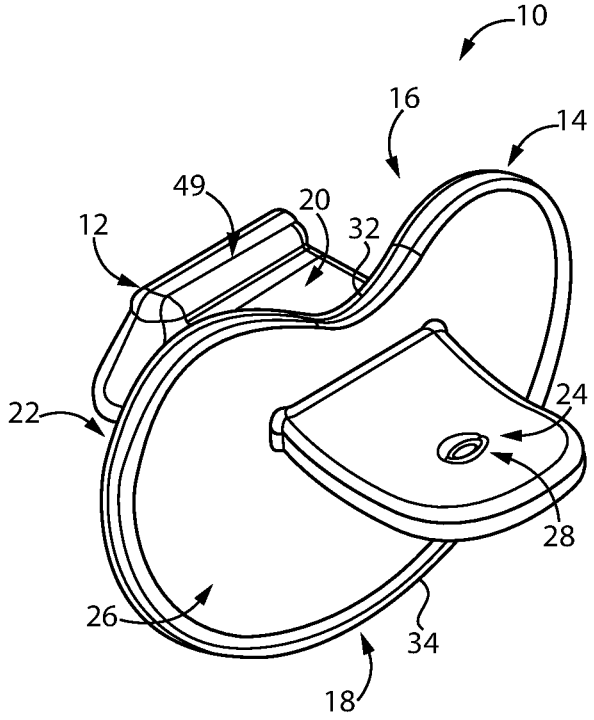
FIG. 1 is a front perspective view of a pacifier.

Corresponding reference characters indicate corresponding parts throughout the several views. Although the exemplification set out herein illustrates embodiments of the present application, in several forms, the embodiments disclosed below are not intended to be exhaustive or to be construed as limiting the scope of the present application to the precise forms disclosed.

DETAILED DESCRIPTION

While exemplary embodiments incorporating the principles of the present disclosure have been disclosed herein, the present disclosure is not limited to the disclosed embodiments. Instead, this application is intended to cover any variations, uses, or adaptations of the disclosure using its general principles. Further, this application is intended to cover such departures from the present disclosure as come within known or customary practice in the art to which this invention pertains.

Commonly used pacifiers try to mimic breast feeding without any concern for normal function of the tongue, proper swallowing, proper breathing, proper lower jaw position in relation to the upper jaw, thumb sucking etc. The position of the false nipple in a typical pacifier slants upward and the infant places the tongue under the nipple. In a breast feeding child, the soft breast gets pushed up against the palate and encourages proper development of the upper arch. The common pacifier design encourages a similar action, but there is no expansion of the breast that takes place. The pliable nipple might get squeezed against the palate, but does not expand like the breast and as a result the upper arch lacks proper development. A swallow in such a case teaches the child to position the tongue within the mandible and not within the maxilla in an elevated position, and the palate does not develop in width which reduces nasal breathing and encourages mouth breathing. That is extremely harmful to normal development.

In the disclosed embodiments, in order to encourage the child to have an elevated tongue position during a swallow, the nipple is slanted downward and not upward as it is in all other pacifiers. This enhances an increase in width of the palate, which encourages proper nasal breathing.

Also pacifier use of known pacifiers can be detrimental to a child's nasal development, so an effort to discourage its use is more helpful for the infant's proper oral development. As the child has the pacifier in the mouth for hour after hour, every time the child swallows, the child's tongue is in an improper position, getting held low in the oral cavity below the known upward false pacifier nipple. Since a child swallows about 2 times every minute, for every hour of pacifier wear, the child is being taught to swallow 120 times per hour in an improper manner. An infant can develop habits very easily and is being taught to swallow improperly as a result. When the pacifier is out of the mouth, the infant swallows with a low tongue position, and an abnormal swallow accompanied with a tongue thrust develops. This also is often followed by an open bite and has an adverse effect on the proper eruption of the permanent incisors which start at about 6 years of age as well as the deciduous incisors which erupt at about 6-7 months of age.

It is also understood that proper mandibular development prior to the eruption of the posterior deciduous molars at about 9-16 months for the $1^{st}$ deciduous molars (and 20-24 months for the $2^{nd}$ deciduous molars), the occlusion in its antero-posterior relation of the lower and upper occlusion is established and does not alter thereafter. When the infant is born, the lower jaw is very retrusive and proceeds forward for most infants in the first year to the second year while there is no posterior occlusion present. Open mouth swallowing discourages this forward development of the mandible and a Class II type malocclusion can be the result. If the jaw does not fully develop at this early age, it usually will not develop properly after 20 months of age. An abnormal swallow encourages more vertical growth of the face and increases the tendency for mouth breathing at the expense of proper nasal breathing.

Mouth breathing at a young age increases oropharyngeal obstruction with reduced oxygen intake, which in turn affects the immune and endocrine systems as well as brain function. This tends to affect growth, allergies, infections, and many symptoms involved in normal behavioral and social development.

If a parent decides to give a child a pacifier, it would be important to give one that improves and encourages normal oral cavity function that involves encouraging proper tongue position high within the palate. This can be accomplished by having the false nipple to be slanted downward, instead of upward, in order to force the tongue to be elevated within the palate, which is the normal position of the tongue. This will encourage proper development of the palate, which will also favor nasal over oral breathing. At the same time it also forces the child to advance the mandible into a more normal antero-posterior position in relation to the upper arch in proportion. When the posterior deciduous first molars begin their eruption at 12 to 14 month of age, these molars are positioned properly within the arch. The mandible is forced to be positioned forward in a trough between the nipple and a lower shield. A shelf is provided for the proper vertical eruption of the deciduous central incisors which erupt at 6 to 7 months of age and followed quickly by the lateral incisors at 7 to 9 months.

These developmental pacifiers would be designed in subsequent sizes to accommodate the eruption that can begin as early as 6 months of age. The first pacifier is designed to be able to properly control the vertical eruption of the central incisors even when they erupt extremely early in life, which can happen. Often current pacifiers are designed with a connector from the nipple of the outer shield by a round or oblong shape that can distort proper eruption and cause an open bite to develop which also alters proper swallowing and tongue position. Therefore, in one or more of the described embodiments, a shelf is included to accommodate at least the deciduous centrals, as well as a portion of extremely wide laterals when this first pacifier is used. The second pacifier to be used, as the child ages while the deciduous canines and molars erupt, includes a wider shelf to control the proper level of these teeth as well as continuing advancement of the mandible and developing proper tongue position which develops the maxillary arch width and encourages normal nasal breathing. The whole purposes of these pacifier stages and their design is to develop normal oral function, encourage development of the arches and growth of the lower jaw and particularly to encourage normal sleep, and to avoid sleep disordered breathing by discouraging abnormal habits that often contribute to these abnormal developments from obstruction of the oropharynx.

The downward slope of the nipple not only encourages an upward position of the tongue within the palate so that when swallowing occurs, the tongue forces itself into the palate and forces it to develop proper palatal width which increases the nasal space for an increase in nasal breathing. The outer shield also is solid without openings to discourage mouth breathing. Forward positioning of the mandible encourages proper growth that prevents retrognathism of the lower jaw with a narrowed airway.

Each subsequent pacifier designed for older ages, reduces the size of the nipple to discourage the need for a pacifier and gradually changes its shape and design into the characteristics of an appliance designed to eliminate all abnormal habits and to encourage proper breathing, oral development of a normally functioning oral area. These succeeding and graduated series of pacifiers discourages improper development and encourage proper function of nasal breathing, swallowing, growth and development of the dentition (without a narrow upper arch) as well as development of the mandible and prevention of extreme facial development with an open bite and an unacceptable jaw and dental relation.

The graduated series of succeeding pacifiers includes one or more of the following advances: Proper antero-posterior and lateral development of the upper arch; Encourages proper nasal breathing; Discourages mouth breathing; Encourages correction of sleep disordered breathing; Provides improvement of an elevated tongue position within the palate; Prevents an open bite; Prevents tongue thrusting; Prevents abnormal swallowing habits; Prevents thumb or finger sucking; Encourages proper mandibular growth which corrects the typical extreme infant overjet; Prevents an excessive long face (increased face height); supports and/and or improves; immune, endocrine symptoms and brain function; support and/or improve speech; Controls eruptions of all deciduous teeth into a normal relationship; and Encourages an infant to eliminate use of the pacifier.

In one or more embodiments, the nipple is slanted downward to encourage tongue to be elevated into palate or the pacifier is made of two materials, one including a relatively stiff material like polypropylene and a second soft, pliable material, like silicone or a thermoplastic elastomer (TPE).

The polypropylene material extends into the shelf, that restricts it from being distorted, and even into the nipple, in some embodiments, to prevent the nipple from being bent upward thereby preventing the child from getting their tongue under the nipple. In one method of manufacture, the pacifier is made of an initial configuration of polypropylene, and silicone or TPE applied to the polypropylene as a second process, which is adhered to the polypropylene.

By having the polypropylene located into the interior of the shelf and of the nipple reduces of prevents the two materials from separating.

The nipple, by being slanted downward, also includes a secondary purpose of advancing the mandible forward which enhances its growth in an anterior direction, particularly before the posterior occlusion is established with the eruption of the $1^{st}$ deciduous molars. Such an eruption, which can exert a substantial vertical occlusal force, which during chewing stabilizes the intercuspation and prevents the mandible from advancing anteriorly (forward) faster than the maxilla.

The shelf that controls the eruption of the incisors initially at about 5 to 6 months of age is only wide enough to accommodate these upper and lower incisors. This eruption controlling shelf can be extended posteriorly around the arch to control the eruption of the deciduous canines and molars ($1^{st}$ and $2^{nd}$ deciduous). These teeth erupt from about 9 months to about 24 months (or even to 30 months).

The present pacifiers are designed to accommodate the child as they receive the incoming deciduous dentition and at the same time to gradually eliminate the bad habits that are established with typical current pacifiers. As a result, the second pacifier appliance has a smaller, nipple to discourage its use by the infant of about 6 months of age and older.

A third pacifier has eliminated the nipple together with the shield that has occurred outside of the mouth over the lips is now located inside the mouth in front of the deciduous dentition between the incisors and the lips. The third pacifier is configured to further prevent or to reduce abnormal symptoms such as narrow palates, reduced nasal breathing, sucking habits, mouth breathing, open bites, and/or abnormal swallowing.

The shelf remains in the third pacifier, but is slanted downward lingually to the position of the dentition to encourage the tongue to remain elevated in the oral cavity. The slanted shelf encourages and continues to exert a lateral force by the tongue within the palate to make sure the palate develops width in order to increase nasal breathing.

The space between the downward sloping nipple and the lower portion of the shield is relatively narrow making it uncomfortable for the tongue, which encourages the tongue to position itself into the palate.

A handle is also attached to extend between the lips toward the outside of the mouth. The purpose of this handle is to make sure the appliance is wide enough so that it cannot be aspirated. Another reason for this handle is to be able to attach it to their nightgown while sleeping. It also serves as an exercise handle so that the patient can pull it forward against the lips to strengthen the orbicularis oris muscle and help to strengthen and also to lengthen the lips.

Each of the described embodiments of pacifiers are designed to alter the habit of keeping the tongue in an inferior (lower) position that results from the upwardly sloping artificial nipple that slant upward on known pacifiers. Each of the described pacifiers are also designed to alter the habit of keeping the tongue in an inferior (lower) position are also present in feeding nipples that slant upward used in bottle feeding. What happens in these instances, is that the use of a known pacifier is encourages a low tongue position by its construction. Such use can last up to several hours per day or even at night for a period of several months up to several years. Since a child swallows twice a minute during the day and once a minute at night, this has a dramatic influence on how a child learns how to swallow. It not only encourages a tongue thrust, and abnormal "reverse" or thrusting swallow, but also contributes to an anterior open bite.

FIG. 1 illustrates one embodiment of a pacifier 10 of the present invention for use with a child of from birth to approximately six months of age. While ages of a child are described herein, such ages are provided as a guide but are not considered to be restrictive in any way. Such use is considered to be a recommendation only and other uses are contemplated.

The pacifier 10 includes a downward slanting nipple 12 that forces the tongue to be elevated in its proper position. See also FIGS. 2 and 3. During a swallow, the nipple 12 teaches the tongue to force itself against the palate and spreads itself out as a vacuum is produced which is required for swallowing. The child's (or patient's) tongue, as a result widens itself and pushes the palate and alveolar ridges in an outward or lateral direction which widens the palate. This in turn increases nasal breathing which is the normal way to breathe. The pacifier 10 includes a shield 14 having a top portion 16 and a bottom portion 18 to which the nipple 12 is attached. In one embodiment, the shield 14 is solid without openings or holes which decreases the possibility of mouth breathing for the child.

Figure 5:
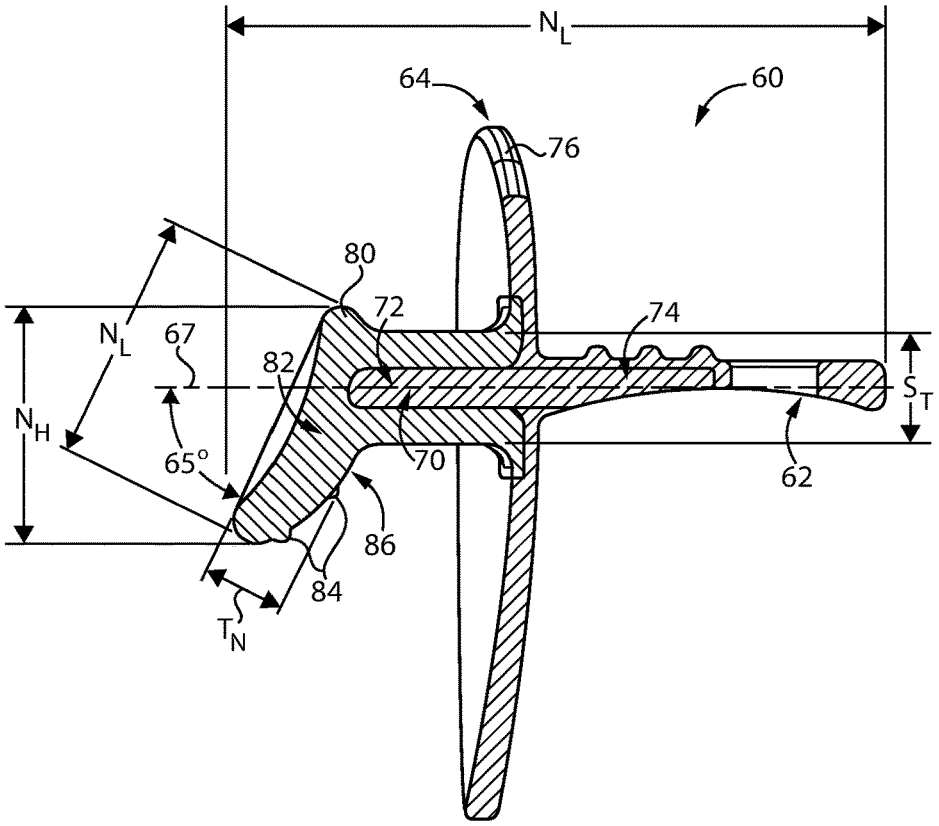
FIG. 5 is an elevation side view of a pacifier illustrating multiple layers of material.

As seen in FIG. 3, the nipple 12 is slanted downwardly from a longitudinal axis 15. A front surface 17 of the nipple 12 is inclined with respect to the longitudinal axis 15 illustrating the downward slant of the nipple 12. An angle 19 of the downward slant is generally between 30 and 90 degrees. In one exemplary embodiment the angle is 65 degrees as seen in FIG. 5.

Figure 2:
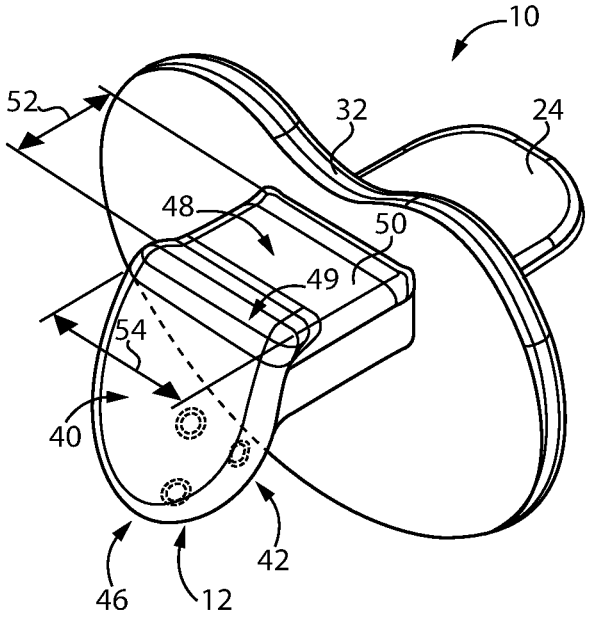
FIG. 2 is a rear perspective view of a pacifier.

A lateral extending shelf 20 extends laterally from a first side 22 of the shield 14 to accommodate the eruption of various teeth that enter the oral cavity at different stages of development. In different embodiments the shelf has varying widths. The shelf 20 is coupled to and located between the nipple 12 and the shield 14. The appliances (pacifiers 10) shown in the illustrations of FIGS. 1, 2, and 3 are configured to accept at least the two deciduous central incisors as well as the laterals in very advanced in age children. In older children (6-12 or 15 months of age) the shelf 20 is extended around the arch to accommodate the eruption of the deciduous canines, $1^{st}$ and $2^{nd}$ molars (upper and lower) (deciduous) that erupt from about 10 to 30 months, usually from 12 to 24 months of age, for instance as illustrated in FIG. 4.

A handle 24 is coupled to and extends from a second side 26 of the shield 14. In one or more embodiments, the handle 24 includes a hole or aperture 28 configured to be coupled to a connector, such as a clasp, to be coupled to clothing of the child which can reduce the likelihood of the child misplacing the pacifier. In one or more embodiments, the handle 24 includes one or more ridges 30 (see FIG. 3) to allow the fingers of a child to not slip when grasping the handle 14 which also hinders sliding movement of a user's hand on the handle.

The top portion 16 of the shield 14 includes a curved portion 32 having an edge that curves inwardly toward the handle 24 to accommodate locating the pacifier 10 in a proper orientation during use. The bottom portion 18 includes a curved portion 34 having an edge that curves outwardly away from the handle 24. The curved portion 32 of the shield 14 is configured to accommodate the nose of the infant. The shield 14, in different embodiments, is made of various sizes to accommodate various sizes of the face as the child matures.

Figure 3A:
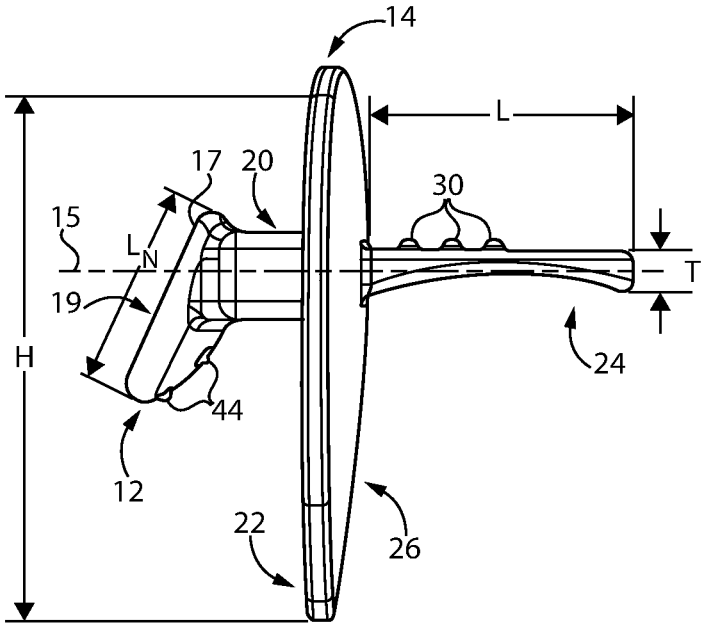
FIG. 3A is an elevational side view of one embodiment of a pacifier.
Figure 3B:
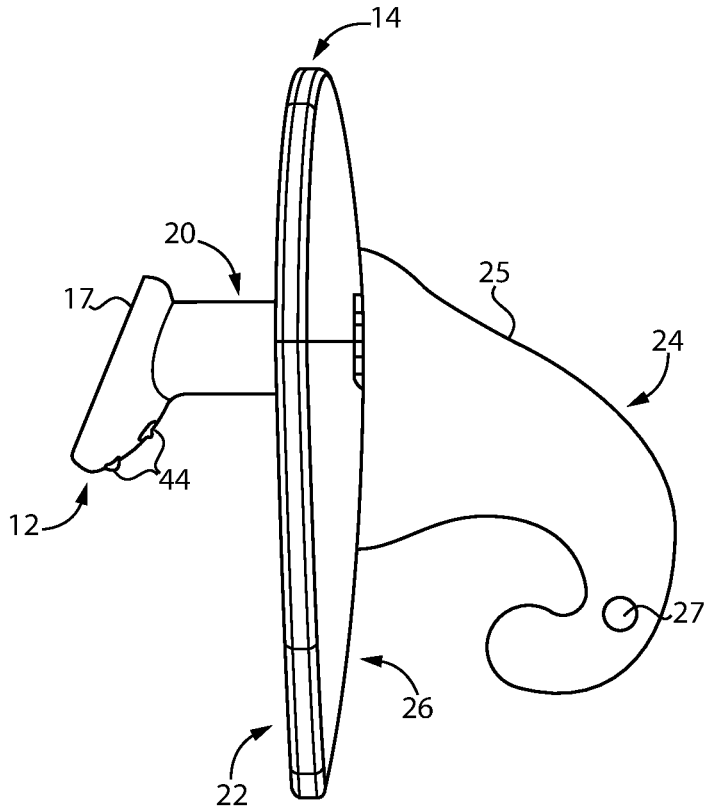
FIG. 3B is an elevational side view of another embodiment of a pacifier.
Figure 4:
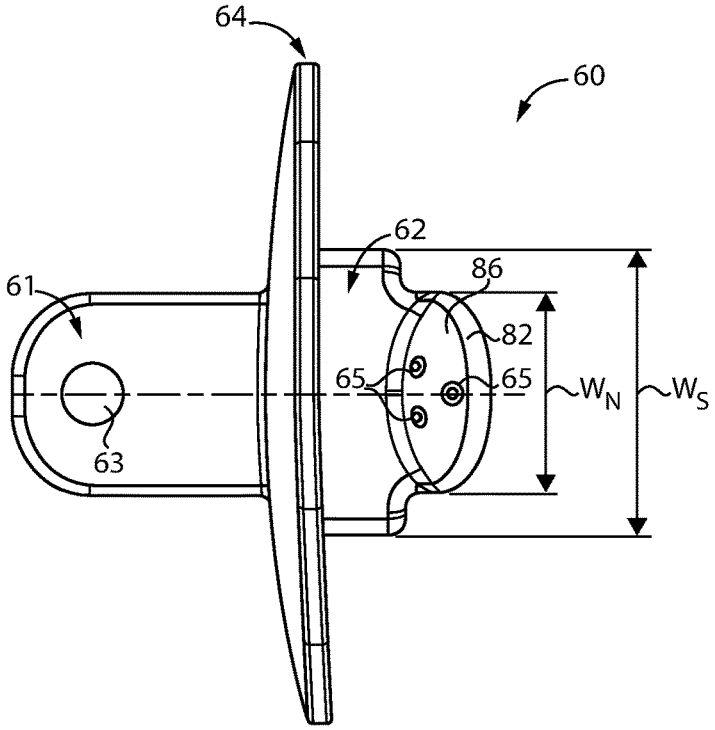
FIG. 4 is a bottom view of a pacifier.

As further illustrated in FIG. 2, the nipple 12 includes a concave side 40 and a convex side 42, wherein the convex side 42 includes one or more projections 44 (see FIGS. 3 and 4). In one embodiment, as seen in FIG. 3, three projection or "bumps" 44 are located on the convex side 42. Other configurations of projections are contemplated. The projections are located on the convex side 42 to distinguish the convex side 42 from the concave side 40 for the child. By including the projections on one side only, the child's tongue is directed toward the concave side 40.

The first side 22 of the shield 14 includes a concave surface being concave in the same direction as the concave side 40 of the nipple 12. The second side 26 of the shield is convex. By forming the first side 22 as a convex surface, the shield is adapted to cooperate with the child's teeth and cheeks on the upper and lower jaw.

The nipple 12 includes a curved bottom portion 46 and a relatively planar top portion 48. The top portion 48 defines a raised portion 49 with respect to a relatively planar surface 50 of the shelf 20. As seen in FIG. 2, a trough or channel 50 includes a planar portion that is disposed between the planar top portion 48 and the first side 22 of the shield 14 configured to locate the gums and/or teeth of the child. As seen in FIG. 2, the trough 50 includes a length 52 and a width 54. In the embodiment of FIGS. 1 and 2, the width 54 of the trough 50 is substantially the same width as the nipple 12. In another embodiment as further illustrated in FIG. 4, the width of the shelf is wider than the width of the nipple 10.

FIG. 3A shows an illustrative embodiment of the pacifier for a child of from 0 to 6 months of age. In one embodiment, a height, H, of the shield is approximately 1.5 inches. A length, L, of the handle 24 is approximately 0.8 inches. A thickness, T, of the handle 24 is approximately 0.115 inches. In different embodiments, the handle 24, as illustrated in FIG. 3B, includes different configurations, each of which mimics a part of an animal or a part of other animate or inanimate figures. Examples of such parts include wings, noses, and ears of different kinds of animals. In one embodiment, the handle 24 is formed in the shape of an elephant's trunk 25. In one or more embodiments, the handle formed in the shape of an animal part includes an opening 27 to secure a cord or string to be attached to the nightgown or pajamas of a user.

Figure 6:
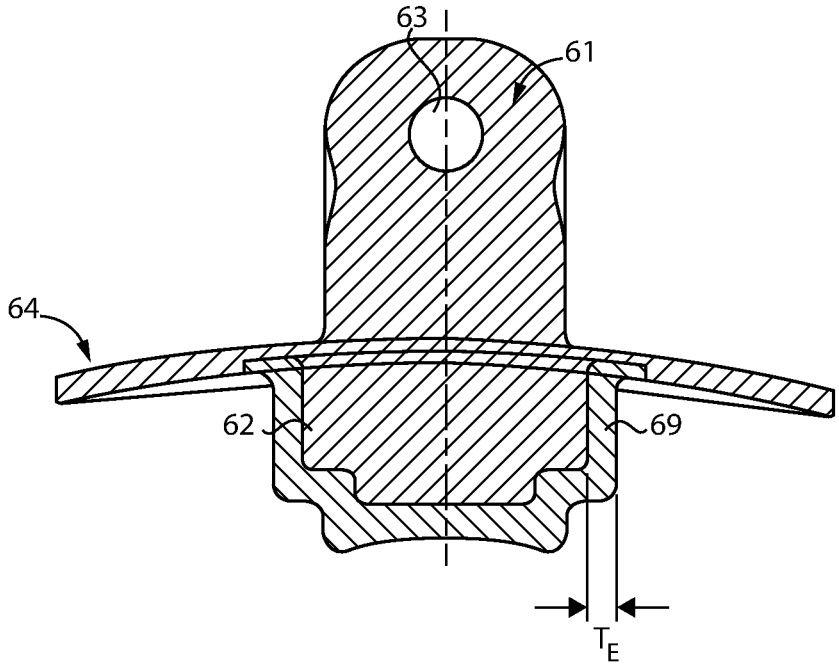
FIG. 6 is a top view of a pacifier illustrating multiple layers of material.

FIGS. 4, 5, and 6 illustrate another embodiment of a pacifier 60 for a child in the age range of between 6 and 13 months of age. This is a second pacifier in the range of pacifiers described herein where certain features are modified from one pacifier directed to a first age group and to another pacifier directed to a second age group. By staging pacifiers, a child is accommodated as the child ages. In this age range of 6 to 13 months, the pacifier is configured to accommodate the erupting deciduous teeth, namely the upper and lower deciduous incisors that erupt between 6 and 13 months of age. In this embodiment, the pacifier 60 includes a handle 61 and a shelf 62, having a width $W_s$, that is wider than the shelf 20 of the 0-6 month appliance of FIGS. 1, 2, and 3. The handle includes a hole 63. In one embodiment, a width increase is about 43%. In other embodiments, a range of width increases is from 20% to 60%. A shield 64 is operatively connected to the shelf 62. In the exemplary embodiment of FIG. 4, the shelf 62 is about 0.25 inches wider than the shelf 20 of FIG. 1. The width of a nipple 82 includes a width $W_N$ that is less than the width $W_s$. The nipple 82 includes one or more of projections 65. As seen in FIG. 6, a layer 67 of thermoplastic elastomer 69 includes a thickness, $T_E$, of about .08 inches. Other thicknesses are contemplated.

The nipple length $L_N$ of the embodiment of FIG. 3, which is for the child of 0 to 6 months, is reduced by about 0.15 inches, (from 0.58 inches to 0.72 inches) in the embodiment of FIG. 4. As a result, the disclosed pacifier of FIG. 4 is designed to adapt to changes in growth and for the eruption of groups of deciduous teeth over the first two years of life. One of the main purposes of the present invention is to gradually reduce the size of the nipple so that it becomes smaller as the child ages. In this manner, the child gradually gets used to each succeeding smaller size of the nipple until it no longer is present in later iterations of the pacifier. While the nipple size is reduced, i.e. becomes smaller in one or both of length as well as width, the shield correspondingly becomes larger in to accommodate the larger sizes of the jaws as the child ages.

The first pacifier is used from birth to 6 months of age. The second pacifier is modified, when compared to the 0 to 6 month old appliance, to adapt comfortably for the 6 to 12 or 15 month old infant. The downward slanted nipple shown in FIG. 5 is shorter by about 21%, in one embodiment, when compared to the embodiment of FIG. 3. In different embodiments, the reduction in length ranges between 10% to 30%. The nipple 82 of FIG. 5 has a thickness TN that is reduced in thickness by about 34% when compared to the nipple of FIG. 3. The reduced thickness makes the pacifier less comfortable to continue to discourage the infant from attempting to move the nipple into an upward position. The nipple 82 includes a length $N_L$, which in one embodiment is approximately 0.6 inches in lengths. The shelf 62 includes a thickness of $S_T$, which in one embodiment is 0.26 inches. A height, $N_H$, of the nipple about a longitudinal line 67 in one embodiment is 0.55 inches. A length $N_L$ is about 1.5 inches. Other sizes of the features of nipple 60 are contemplated.

The shield 64 of the embodiment of FIG. 4 is made wider, when compared to the pacifier for 0-6 months of age, by about 15% and in height by about 25%. This increase is to adapt to the child's face in size and to further prevent mouth breathing and to increase nasal breathing.

FIGS. 5 and 6 illustrate the second embodiment of FIG. 3 including a core 70 having a core shelf 72, a core handle 74, and a core shield 76. The embodiments of FIGS. 1, 2, and 3 includes a similar construction. In this embodiment, the core 70 is made of a harder plastic, such as polypropylene, or other materials having a higher hardness durometer. The core 70 is covered by an outer layer 80 formed of a softer material such as thermoplastic elastomer (TPE), thermoplastic rubber, silicone or rubber. The core shelf 74 extends as a part of the shelf 62 of FIG. 4 to provide stability to the shelf and to prevent a nipple 82, of FIG. 4 and FIG. 5, from being displaced. As illustrated in FIG. 5, the nipple 82 is primarily formed of the softer material. Other embodiments are contemplated, however, where the core 70 includes features extending into the nipple 82 including those that are inclined with respect to the core shelf 72. The core shelf 72 provides a certain rigidity to the nipple 82 which holds the nipple 82 in a relatively fixed position, particularly if the tongue is forced under the nipple by the child to try and elevate the nipple. If this rigidity was reduced, the purpose of the pacifier to elevate the tongue would be reduced or substantially eliminated. The nipple 82 includes a plurality of projections or bumps 84 located on the convex side 86.

The core 70, i.e. polypropylene insert, inside the shelf 62, provides a shelf that is wider than shelf 20 of FIG. 1 by about 44%, or from about 16 mm to 23 mm. The purpose of this wider shelf is to accommodate wider than normal deciduous incisors particularly the upper centrals and laterals that can reach a width of 26.7 mm, while the shelf 62 is 23 mm.

As described herein, two or more pacifiers are configured to address the growth patterns of a child from an infant of 0 to a child of 24 months or more. The first pacifier, in a series of pacifiers, is generally directed to a child of 0 to 6 months of age. A second pacifier, in the series of pacifiers, is generally directed to a child of 6 months to 12 months of age. Additional pacifiers are configured for each succeeding age group, for instance 13 months to 18 months, and 19 months to 24 months. For each succeeding pacifier, the nipple becomes smaller when compared to a prior age group pacifier, and the shelf becomes wider when compared to a prior age group pacifier. The pacifiers are sold as individual pacifiers marked with the proper age group to which the pacifier is directed. In other embodiments, the first two or first three pacifiers are sold together in a single package to accommodate the advancing age of the child.

Additional appliances for an age group of 1 to 4 years, an age group of 4-6 years, as well as for an age group of 7-12 (or 6-12 depending on an individual's maturity and size) can be seen in U.S. Pat. No. D722,171, entitled Oral Appliance, issued Feb. 3, 2015, which is incorporated by reference herein in its entirety.

While exemplary embodiments incorporating the principles of the present disclosure have been disclosed herein, the present disclosure is not limited to the disclosed embodiments. Instead, this application is intended to cover any variations, uses, or adaptations of the disclosure using its general principles. Further, this application is intended to cover such departures from the present disclosure as come within known or customary practice in the art to which this invention pertains.

What is claimed is:

1. A pacifier comprising:

a shield having a first side, a second side, a top portion, and a bottom portion, wherein the top portion is curved inwardly toward the handle to accommodate a nose of an individual, wherein the handle extends from the first side, the handle defining a longitudinal axis;

a nipple extending from the second side, wherein the nipple is inclined with respect to the longitudinal axis and extends downwardly from the longitudinal axis, the nipple including a top portion defining a raised portion, the nipple having a concave side and a convex side, wherein the concave side is recessed from a front surface of the nipple and the convex side is located between the concave side and the shield, wherein the convex side includes one or more projections and the convex side is without any projections, wherein the one or more projections are configured to distinguish the concave side from the convex side for a tongue of a user and to direct the tongue toward the concave side; and a shelf extending from the raised portion to the second side of the shield, wherein the shelf includes a substantially planar surface, the raised portion is raised with respect to the substantially planar surface, and the substantially planar surface is continuously planar from the raised portion to a connection of the shelf to the shield, wherein the raised portion of the nipple extends toward the shield.

2. The pacifier of claim 1 wherein at least one of the one or more projections is located below a horizontal centerline of the convex side.

3. The pacifier of claim 1 wherein the shelf is substantially parallel to the longitudinal axis.

4. The pacifier of claim 3 wherein the shelf between the raised portion and the second side of the shield defines a trough, wherein the trough includes a dimension configured to locate a gum or tooth structure of the user.

5. The pacifier of claim 4 wherein the nipple includes a first lateral width and the shelf includes a second lateral width wherein the first lateral width is smaller than the second lateral width.

6. The pacifier of claim 4 wherein the nipple includes a first lateral width and the shelf includes a second lateral width wherein the first lateral width and the second lateral width are substantially the same width.

7. The pacifier of claim 1 wherein the first side of the shield is convex and the second side of the shield is concave.

8. The pacifier of claim 7 wherein the top portion of the shield includes a first curved edge having an intermediate portion, wherein the intermediate portion curves towards the handle.

9. The pacifier of claim 8 wherein the handle includes one or more projections configured to hinder sliding movement of a user's hand on the handle.

10. The pacifier of claim 1 wherein the nipple is inclined with respect to the shield at an angle of between zero and ninety degrees with respect to the longitudinal axis.

11. The pacifier of claim 10 wherein the top portion of the nipple is substantially planar and nipple includes a curved bottom portion.

12. The pacifier of claim 11 wherein the planar top portion generally is parallel with the substantially planar surface of the of the shelf.

13. A pacifier including a handle extending from a shield and configured to encourage elevation of an individual's tongue into the individual's palate, the pacifier comprising:

a shield having a first side, a second side, a top portion, and a bottom portion, wherein the top portion is curved inwardly toward the handle to accommodate a nose of the individual;

a nipple angulated downward from a longitudinal axis extending from a front of the pacifier to the back of a pacifier, the nipple including a top portion defining a raised portion, a bottom portion spaced from the top portion, and a front surface facing the mouth of the infant, the front surface having a downward slope inclined with respect to the longitudinal axis and located between the top portion and the bottom portion, wherein the bottom portion is spaced further from the shield than the top portion is spaced from the shield, and wherein in a side view of the front surface, the front surface is substantially planar; and a shelf having a first end and a second end, terminating at the shield, the first end operatively connected to the raised portion, the shelf extending from the raised portion toward the shield, wherein the shelf includes a substantially planar surface, the raised portion being raised with respect to the substantially planar surface, and the substantially planar surface is substantially continuously planar from the raised portion to the second end, wherein the top portion of the nipple extends toward the shield and connects to the raised portion of the shelf and wherein the shelf is configured to receive incisal deciduous teeth of the individual.

14. The pacifier of claim 13 wherein the nipple includes a nipple width and the shelf includes a shelf width, wherein the nipple width is one of being substantially the same as the shelf width or being less than the shelf width.

15. The pacifier of claim 14 wherein the pacifier includes a core and an outer layer disposed on the core.

16. The pacifier of claim 15 wherein the core is formed of a first material and the outer layer is formed of a second material, wherein the second material is softer than the first material.

17. A pacifier including a handle, the pacifier comprising:

a shield having a first side, a second side, a top portion, and a bottom portion, wherein the top portion is curved inwardly toward the handle to accommodate a nose of an individual;

a handle extending from the first side, the handle formed to resemble a part of an animal, the handle including an opening to receive a cord; and a nipple extending from the second side, wherein the nipple is inclined with respect to the longitudinal axis and extends downwardly from the longitudinal axis, the nipple including a top portion defining a raised portion, a bottom portion spaced from the top portion, and a sloped surface between the bottom portion and the top portion, the bottom portion being spaced further from the shield more than the top portion is spaced from the shield; and a shelf operatively connected to the top portion, the shelf extending from the raised portion toward the second side of the shield, wherein the shelf includes a substantially planar surface, wherein the raised portion of the nipple extends towards the shield and is raised with respect to the substantially planar surface, and the substantially planar surface is substantially continuously planar from the raised portion to the second side of the shield.

* * * * *